US011676560B2

(12) United States Patent
Jackson

(10) Patent No.: US 11,676,560 B2
(45) Date of Patent: Jun. 13, 2023

(54) STRINGS SADDLE OR YOKE FOR A MUSICAL INSTRUMENT, AND RELATED METHODS OF CORE OVER INSTALLATION

(71) Applicant: David Jackson, Dahlonega, GA (US)

(72) Inventor: David Jackson, Dahlonega, GA (US)

( * ) Notice: Subject to any disclaimer, the term of this patent is extended or adjusted under 35 U.S.C. 154(b) by 0 days.

(21) Appl. No.: 17/502,436

(22) Filed: Oct. 15, 2021

(65) Prior Publication Data

US 2023/0120690 A1 Apr. 20, 2023

(51) Int. Cl.
*G10D 3/12* (2020.01)
*G10D 3/04* (2020.01)

(52) U.S. Cl.
CPC ..... *G10D 3/12* (2013.01); *G10D 3/04* (2013.01)

(58) Field of Classification Search
CPC ..... G10D 13/02; G10D 13/16; G10D 13/00
See application file for complete search history.

(56) References Cited

U.S. PATENT DOCUMENTS 4,581,976 A * 4/1986 Ball ..... G10D 3/10 84/297 S

* cited by examiner

*Primary Examiner* — Kimberly R Lockett
(74) *Attorney, Agent, or Firm* — Buche & Associates, P.C.; John K. Buche; Bryce A. Johnson

(57) ABSTRACT

Disclosed is an improved string saddle or yoke that can have a string bent thereover without causing a separation of the string's windings.

3 Claims, 5 Drawing Sheets

STRINGS SADDLE OR YOKE FOR A MUSICAL INSTRUMENT, AND RELATED METHODS OF CORE OVER INSTALLATION

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of musical instruments, including string saddles, yokes, and/or tailpieces.

Background of the Invention

Stringed instruments, e.g. guitars, make sounds via string vibrations. Many guitar strings are defined by a core and a winding. The core defines the length of the string and a thin wire is wrapped around the core to define the windings. Windings can be roundwound, flatwound, or groundwound. See, e.g., FIG. 1.

In some cases, a string may suitably be installed on a stringed musical instrument via securing one end of the string to a fixture, bending a string over a nut, pulling the string taut, bending the string taught over a saddle or yoke, and then securing the other end of the string under the pulled tension. The tension can be tightened or loosed after the initial installation.

U.S. Pub. Pat. App. US2014/0196590 (published Jul. 17, 2014) by Glaser II et al. shows in FIG. 1 (reproduced here as FIG. 1) a guitar with a string installed according to the traditional method described above. More specifically, a guitar string 16 is shown bent over a saddle or yoke 22. While suitable for producing sound, unfortunately, the bending of the string 16 over the saddle or yoke is neither entirely satisfactory to all musicians nor suitable for producing sounds in all circumstances because the windings of the strings separate from one another as the string is bent over the nut or saddle/yoke. This separation of the windings has a deleterious effect on sound quality. Some have described the deleterious effect as being a "blanket" over the tone of the strings. Other's have said such a string sounds dead after installation because there is insufficient clarity and ring.

SUMMARY OF THE INVENTION

In view of the foregoing, an object of this specification is to disclose an improved string saddle, yoke, and or tailpiece that can have a string bent thereover without causing a separation of the string's windings. In a preferred embodiment a string may be defined by a core and winding, wherein the core extends beyond the windings on one or both ends of the string. In a preferred embodiment, a musical instrument features a nut and a bridge defined by at least one saddle, yoke, or bridge. In the preferred embodiment, a saddle is defined by a block with a riser that has a knife edge or tangential edge. In the preferred embodiment, the block or tailpiece features a canal with a string receptacle so that the string's core core that is exposed on one end of the string can bend over the knife edge or tangential edge and secured to the block or tailpiece while the string's core and windings on the other end are bent over the nut and affixed to the musical instrument so that the winding of the string is disposed or begins a distance from the knife edge or tangential edge of the saddle. Although scales may differ sometimes depending on the type of stringed instrument, the invention may be accomplished by ensuring the string's windings begin and end at a distance from the and saddle or bridge of a subject instrument.

In a preferred embodiment, the string is affixed to the musical instrument via a key so that the tension of the string between the nut and the saddle may be adjusted by turning the key. In another preferred embodiment, the string may be tuned via a stretching device (e.g., tremolo or vibrato) connected to the saddle.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

Figure 1:
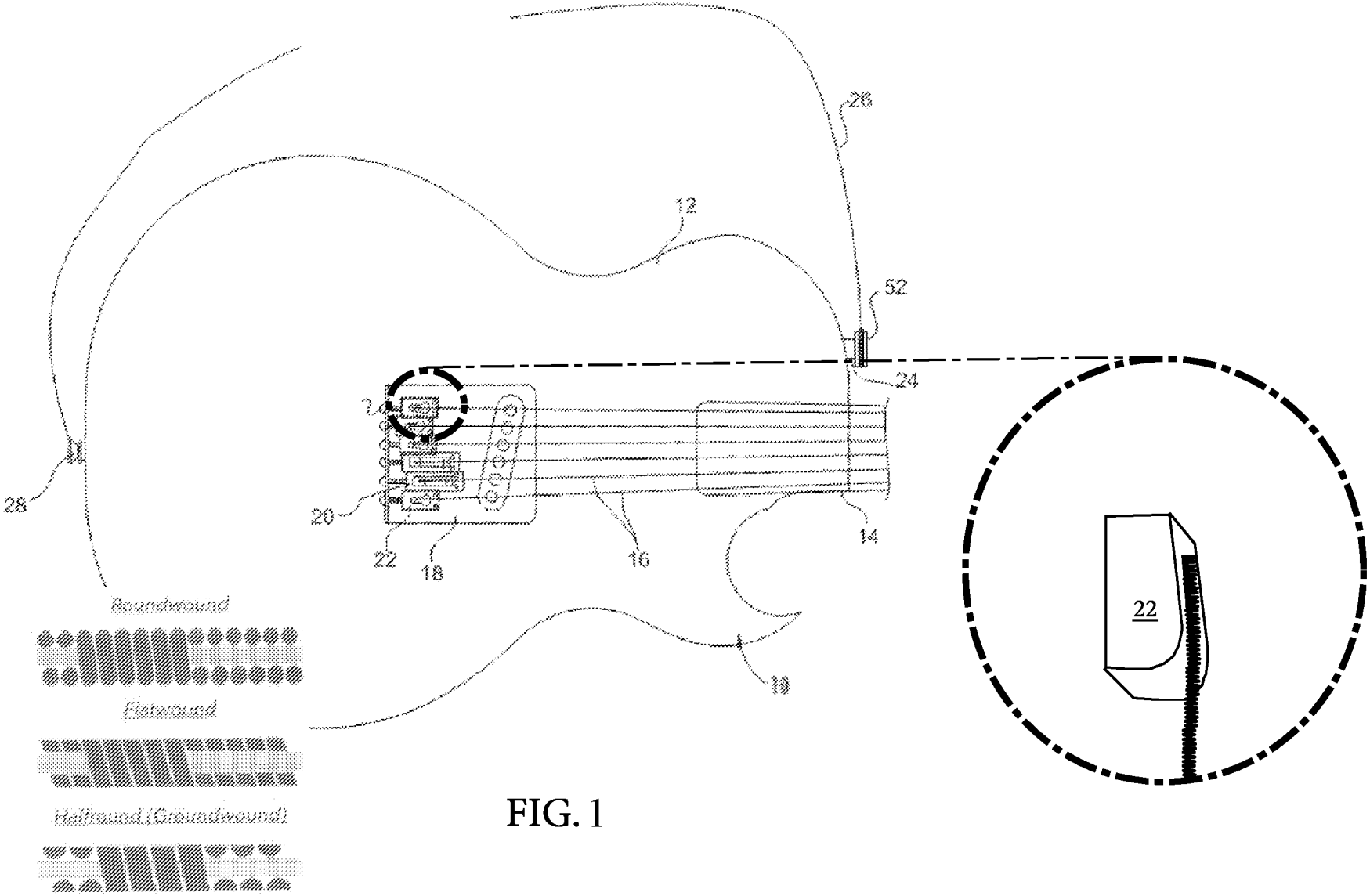
FIG. 1 is a modified reproduction of FIG. 1 of U.S. Pub. Pat. No. US2014/0196590 (published Jul. 17, 2014) by Glaser II et al.

In the figures, the following components are identified by the following reference numerals:

Saddle or yoke 100;

Block 110;

Groove 111;

Horizontal bore 113 for axial positioning screw;

Vertical bore 114 for height adjustment screw;
Vertical bore 115 for height adjustment screw;
Groove bore 116
Riser 120;
Knife edge or tangential edge 121;
Shelf 122;
Shelf bore 123;
wound string 200;
winding 210;
core 220;
bridge 500;
tail piece 600 and,
instrument 1000.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is an improved string saddle, yoke, or bridge that can have a string bent thereover without causing a separation of the string's core and windings. In particular, disclosed is a saddle with a riser that has a knife edge or tangential edge over which the core of a wound string may be bent to achieve superior sound quality. The more specific features of the disclosed subject matter are disclosed in connection with the figures.

Figure 2:
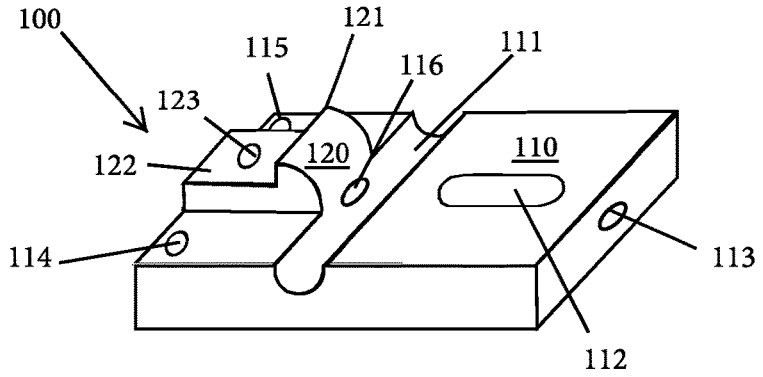
FIG. 2 is a perspective view of a saddle with a knife edge or tangential edge.
Figure 3:
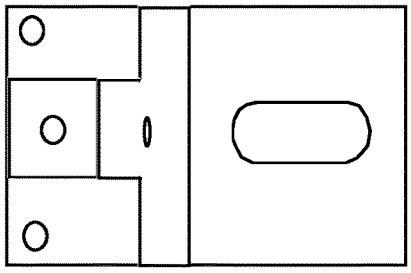
FIG. 3 is a top view of the saddle of FIG. 2.
Figure 8:
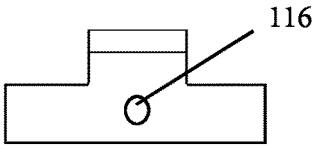
FIG. 8 is a front view of the saddle of FIG. 2.
Figure 4:
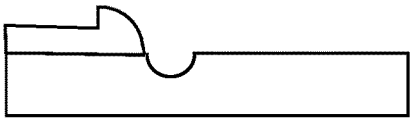
FIG. 4 is a left-side view of the saddle of FIG. 2.
Figure 7:
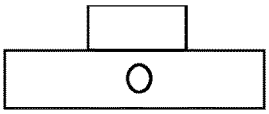
FIG. 7 is a back view of the saddle of FIG. 2.
Figure 5:
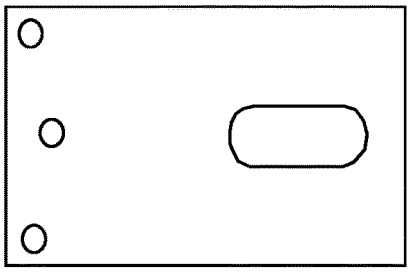
FIG. 5 is a bottom view of the saddle of FIG. 2.
Figure 6:
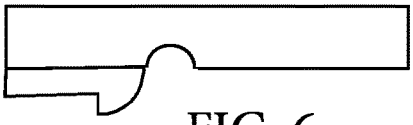
FIG. 6 is a right side view of the saddle of FIG. 2.

FIG. 2 is a perspective view of a saddle 100 with a knife edge or tangential edge 121. FIG. 3 is a top view of the saddle 100; FIG. 4 is a left-side view of the saddle 100. FIG. 5 is a bottom view of the saddle 100. FIG. 6 is a right side view of the saddle 100. FIG. 7 is a back view of the saddle 100. FIG. 8 is a front view of the saddle 100.

Referring to FIGS. 2 through 8, the saddle 100 may suitably be defined by a block 110 and riser 120. As shown, the block may include: a groove 111; a horizontal bore 113 for receiving an axial positioning screw (not shown) and for attaching the saddle 100 to a musical instrument or the instrument's bridge and string stretching mechanism (e.g. circled portions of FIG. 9); a set of vertical bores 114/115 for receiving a set of height adjustment screws (not shown) so that the height of the string relative to the musical instrument may be adjusted in a fashion common to the industry; and a groove bore 116 for receiving the tip of the string's exposed core (see FIG. 9). As further shown, the riser 120 may be defined on one side by a knife edge or tangential edge of a quarter-cylinder and defined on the other side by a shelf with a shelf bore for receiving a set screw that clamps the tip of the string's exposed core (see FIG. 9) after it has been provided through the groove bore 116.

Figure 9:
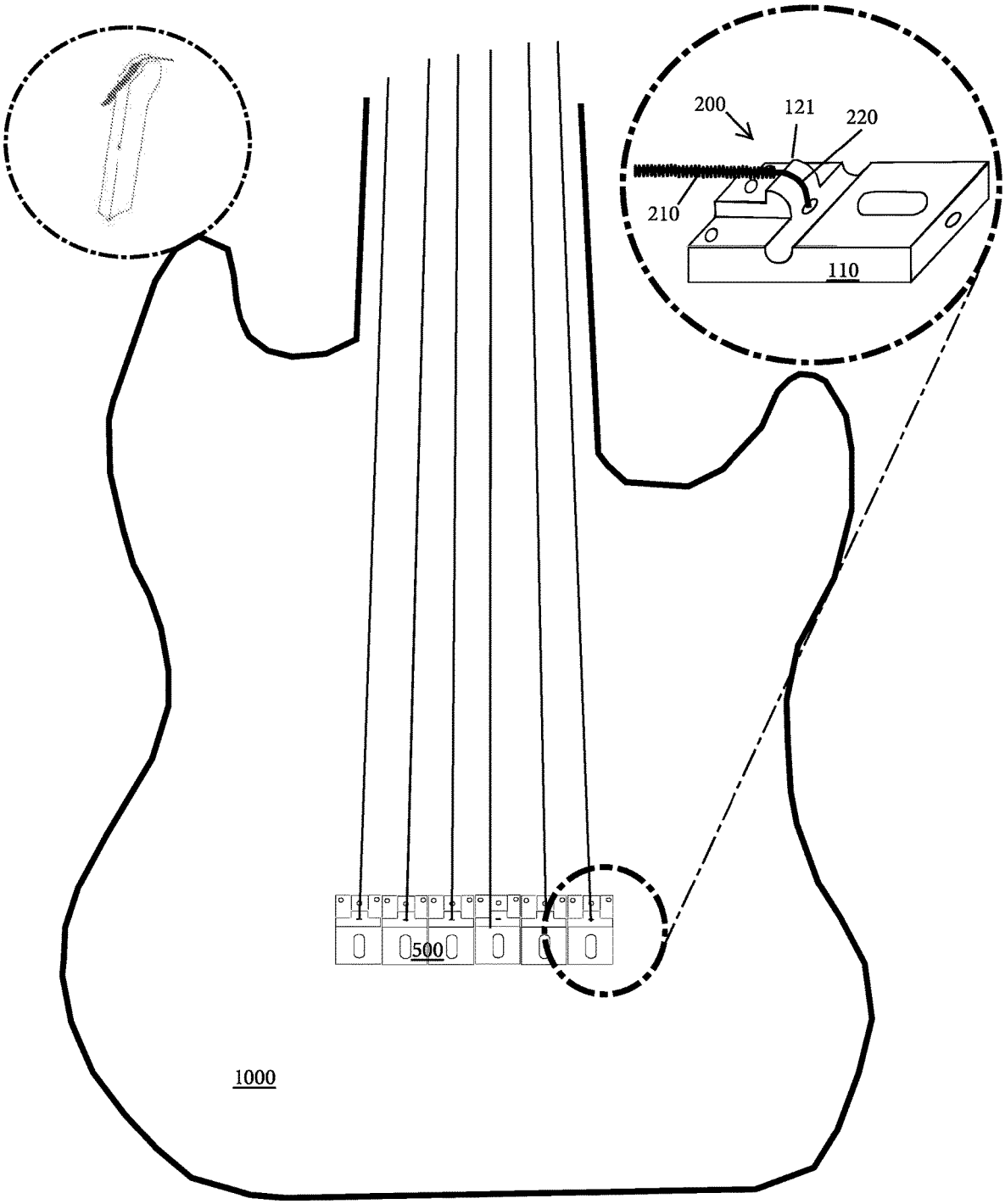
FIG. 9 is an environmental view of the saddle of FIG. 2 installed on a musical instrument.

FIG. 9 is an environmental view of the saddle 100 installed on a musical instrument 1000. FIG. 9 shows a zoom-in of a wound string 200 installed on a saddle 100 of the instruments bridge 500. Preferably, the winding may be flatwound, roundwound, or groundwound. As shown, the tip of the core 220 has been provided through the groove bore 116 and secured therein via a clamping action of a set screw in the shelf bore 123. Suitably, the core 220 has been bent over the knife edge or tangential edge and strung along the quarter-cylinder of the riser 120. Also shown is the winding 210 of the string 200 disposed adjacent to the knife edge or tangential edge 121.

In a preferred embodiment, the string is affixed to the musical instrument via a key so that the tension of the string between the nut and the saddle may be adjusted by turning the key. In another preferred embodiment, the string may be tuned via a stretching device (e.g., tremolo or vibrato) connected to the saddle. It should be appreciated that, though scales may differ sometimes depending on the type of stringed instrument, the invention may be accomplished by ensuring the string's windings begin and end between the nut and saddle of a subject instrument (i.e., at a distance from the knife or tangential edge of the saddle, bridge, or yoke.

Figure 10:
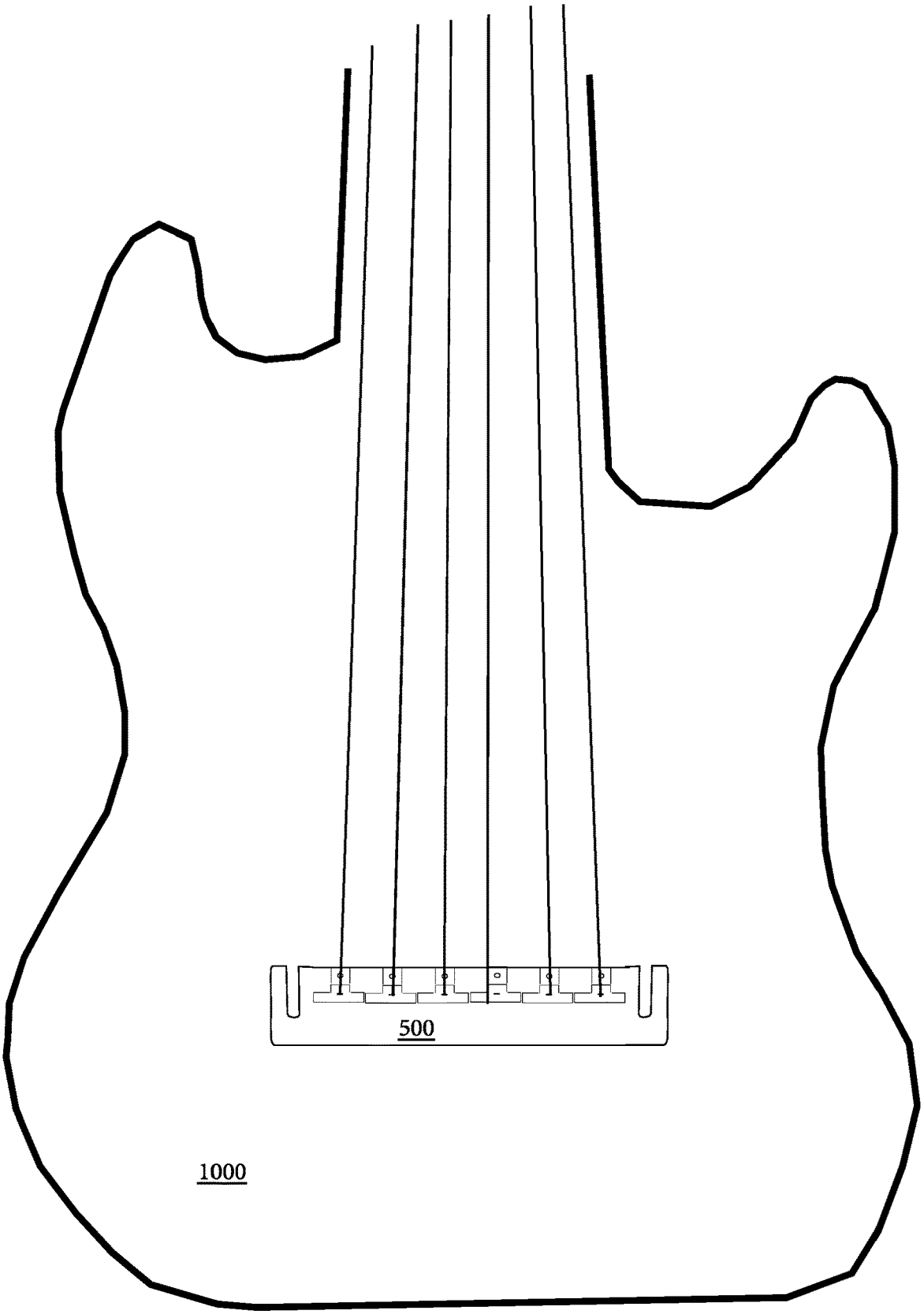
FIG. 10 is an environmental view of an alternate embodiment of the saddle installed on a musical instrument; and, FIG. 11 is an environmental view of another alternate embodiment of the saddle installed on a musical instrument.

FIG. 10 is an environmental view of an alternate embodiment of the saddle installed on a musical instrument. FIGS. 1 through 9 show individualized saddles that provide means for the core of a string beings secured to the saddle so that the windings of the string begin after the apex of the saddle. However, this concept could be similarly accomplished by a bridge (as shown in FIG. 10) rather than by the individual saddles of FIGS. 1 through 9. In the embodiment depicted by FIG. 10, a single unit 500 bridge may be secured to the top of a guitar 1000 to provide a hole for the core of a wound string with a clamping devices (as in the earlier embodiments) for locking the core over the apex of the bridge. In this embodiment, the core of the string is on the tangent apex of the bridge 500 while the windings of the string began at a distance from the knife edge or tangential edge.

Figure 11:
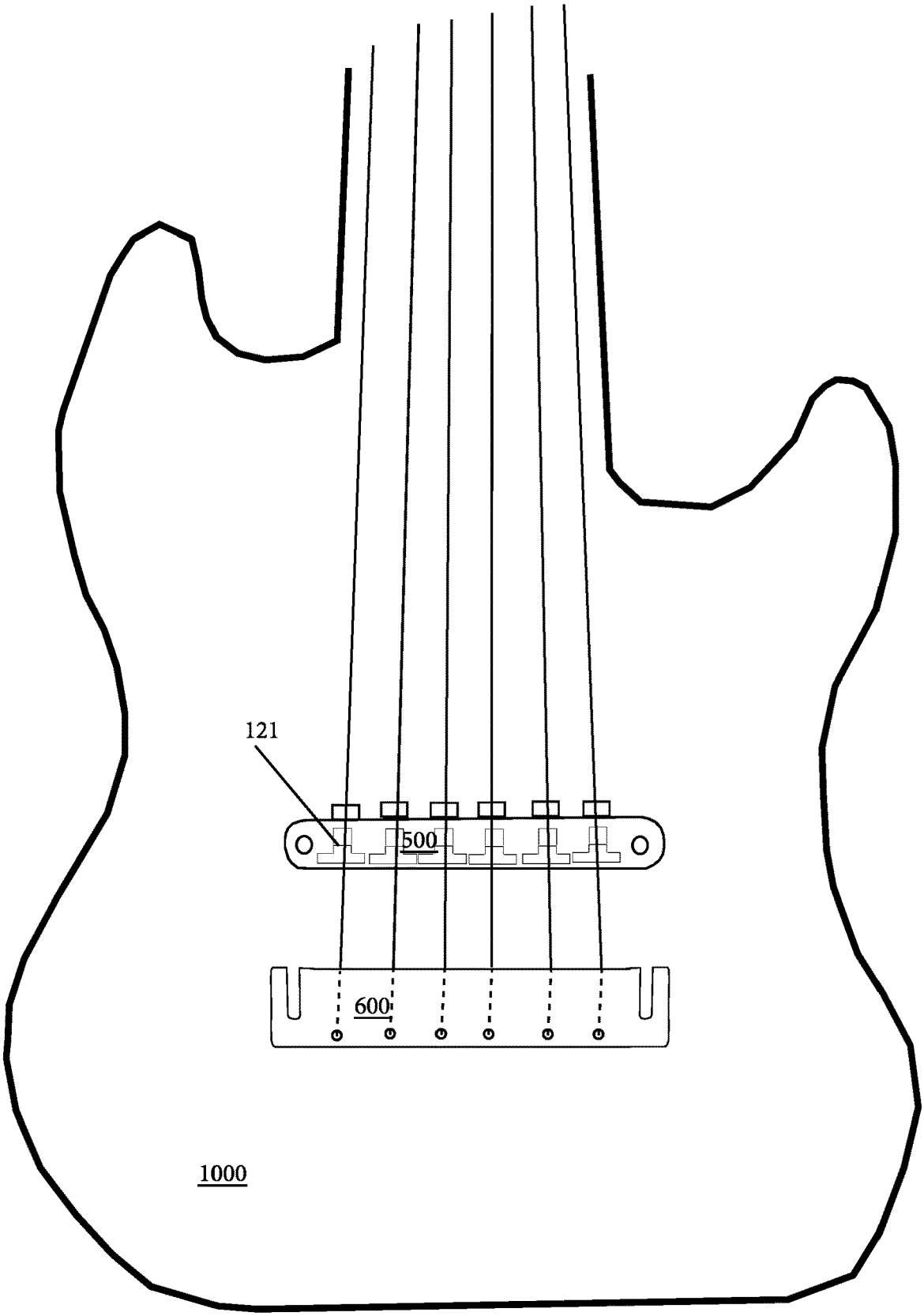

FIG. 11 is an environmental view of an alternate embodiment of the saddle 500 installed on a musical instrument 1000. FIGS. 1 through 9 show individualized saddles that provide means for the core of a string being secured to the saddle so that the windings of the string begin after the apex of the saddle. However, this concept could be similarly accomplished by a bridge 500 (as shown in FIG. 10) with individual risers that each have a knife edge or tangential edge 121 wherein the risers may be raised or lowered to adjust intonation. In the embodiment depicted by FIG. 11, the core of the string is on the tangent apex 121 of the bridge 500 while the windings of the string began at a midpoint of the string (e.g., apart from the knife or tangential edge of the bridge, saddle, or yoke).

Now, standard strings have a core exposed on one end and a ball on the other end. Traditionally, the exposed core is installed on the key of the musical instrument whereas the ball is installed on the bridge of the instrument. However, when an instrument is outfitted with the saddle or bridge of the present disclosure, a standard string may be installed in what would be considered an upside-down orientation relative to traditional installation. In other words, the exposed core of the string may be installed in the saddle or bridge as described above with the ball side installed on the key of the instrument. Those of skill in the art would appreciate that the ball would need to be cutoff or otherwise removed before this installation technique would be practicable.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A saddle for a string musical instrument, said saddle defined by a block with a riser that has a tangential edge, wherein a string may be defined by a core and winding, wherein the core extends beyond the windings on one or both ends of the string, and wherein the block features a canal with a string receptacle so that the string's core that is exposed on one end of the string is strung over the tangential edge and secured to the block so that the riser is located between the string receptacle and the winding of the string, and so that the winding of the string does not contact the tangential edge of the saddle.

2. A bridge for a string musical instrument, said bridge defined by a plurality of blocks wherein each block within the plurality of blocks includes a riser that has a tangential edge, wherein each string within a plurality of strings may be defined by a core and winding, wherein the core of each string extends beyond the windings on one or both ends of the string, and wherein each block features a canal with a string receptacle so that each of the strings' core that is exposed on one end of each of the strings is strung over the tangential edge and secured to each of the blocks so that each riser is located between each respective string receptacle and winding of each respective string, and so that the winding of each of the of the strings does not contact the respective tangential edge of the bridge.

3. A bridge for a string musical instrument, said bridge defined by a plurality of risers wherein each riser within the plurality of risers includes a tangential edge, wherein each string within a plurality of strings may be defined by a core and winding, wherein the core of each string extends beyond the windings on one or both ends of the string, and wherein each of the strings' core that is exposed on one end of each of the strings is strung over the tangential edge and secured to a tailpiece so that each riser is located between each the tailepiece and winding of each respective string, and so that the winding of each of the of the respective strings does not contact the respective tangential edge of the bridge.

* * * * *